US010909925B2

(12) United States Patent
Yue et al.

(10) Patent No.: US 10,909,925 B2
(45) Date of Patent: Feb. 2, 2021

(54) PIXEL CIRCUIT AND DRIVING METHOD THEREOF, DISPLAY PANEL AND DISPLAY DEVICE

(71) Applicant: BOE TECHNOLOGY GROUP CO., LTD., Beijing (CN)

(72) Inventors: Han Yue, Beijing (CN); Xiaochuan Chen, Beijing (CN); Shengji Yang, Beijing (CN); Dongni Liu, Beijing (CN); Lei Wang, Beijing (CN); Li Xiao, Beijing (CN); Pengcheng Lu, Beijing (CN); Jie Fu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 402 days.

(21) Appl. No.: 15/751,300

(22) PCT Filed: Jul. 18, 2017

(86) PCT No.: PCT/CN2017/093290

§ 371 (c)(1),
(2) Date: Feb. 8, 2018

(87) PCT Pub. No.: WO2018/120776

PCT Pub. Date: Jul. 5, 2018

(65) Prior Publication Data

US 2020/0211463 A1 Jul. 2, 2020

(30) Foreign Application Priority Data

Dec. 27, 2016 (CN) ..... 2016 1 1227008

(51) Int. Cl.
*G09G 3/3258* (2016.01)

(52) U.S. Cl.
CPC ..... *G09G 3/3258* (2013.01); *G09G 2360/145* (2013.01)

(58) Field of Classification Search
None
See application file for complete search history.

(56) References Cited

U.S. PATENT DOCUMENTS

2010/0085340 A1* 4/2010 Omoto ..... G09G 3/3233 345/207
2015/0348464 A1 12/2015 In et al.
(Continued)

FOREIGN PATENT DOCUMENTS

CN 104900186 A * 9/2015 ..... G09G 3/32
CN 104900186 A 9/2015
(Continued)

OTHER PUBLICATIONS

International Search Report of PCT/CN2017/093290 in Chinese, dated Aug. 30, 2017 with English translation.
(Continued)

*Primary Examiner* — Ifedayo B Iluyomade
(74) *Attorney, Agent, or Firm* — Collard & Roe, P.C.

(57) ABSTRACT

A pixel circuit and a driving method thereof, a display panel and a display device. The pixel circuit includes a light emitting element, a driving circuit and a compensation voltage acquisition circuit. The driving circuit is configured to drive the light emitting element to emit light; and the compensation voltage acquisition circuit is configured to obtain a compensation voltage based on luminance of the light emitting element, and the compensation voltage can be provided to the driving circuit.

17 Claims, 4 Drawing Sheets

(56) References Cited

U.S. PATENT DOCUMENTS

| | | | | |
|---|---|---|---|---|
| 2016/0267839 | A1 | 9/2016 | Yang | |
| 2018/0005571 | A1* | 1/2018 | Song | G09G 3/3208 |

FOREIGN PATENT DOCUMENTS

| | | | |
|---|---|---|---|
| CN | 105679245 | A | 6/2016 |
| CN | 205648068 | U | 10/2016 |
| CN | 106782319 | A | 5/2017 |
| CN | 206301581 | U | 7/2017 |

OTHER PUBLICATIONS

Notice of Transmittal of the International Search Report of PCT/CN2017/093290 in Chinese, dated Aug. 30, 2017.
Written Opinion of the International Searching Authority of PCT/CN2017/093290 in Chinese, dated Aug. 30, 2017 with English translation.

* cited by examiner

PIXEL CIRCUIT AND DRIVING METHOD THEREOF, DISPLAY PANEL AND DISPLAY DEVICE

CROSS REFERENCE TO RELATED APPLICATIONS

This application is the National Stage of PCT/CN2017/093290 filed on Jul. 18, 2017, which claims priority under 35 U.S.C. §119 of Chinese Application No. 201611227008.7 filed on Dec. 27, 2016, the disclosure of which is incorporated by reference.

TECHNICAL FIELD

Embodiments of the present disclosure relate to a pixel circuit and a driving method thereof, a display panel and a display device.

BACKGROUND

Organic light emitting diode (OLED) display devices have been gradually attracted the attention of people due to wide viewing angle, high contrast, fast response, and advantages such as higher luminance, lower driving voltage and the like over inorganic light emitting diode display devices. The OLED display devices include organic light emitting diodes arranged in an array, the organic light emitting diodes, for example, can be driven to emit light by a driving current outputted by thin film transistors.

SUMMARY

At least one embodiment of the present disclosure provides a pixel circuit, and the pixel circuit comprises a light emitting element, a driving circuit, a luminance detection circuit, a voltage comparison circuit and a compensation control circuit. The driving circuit is configured to drive the light emitting element to emit light; the luminance detection circuit is configured to detect luminance of the light emitting element and obtain a photosensitive voltage corresponding to the luminance of the light emitting element according to the luminance of the light emitting element; the voltage comparison circuit is configured to compare the photosensitive voltage with a reference voltage to obtain a compensation voltage, in which the reference voltage is a photosensitive voltage obtained by the luminance detection circuit in a case that the luminance of the light emitting element is target luminance; and the compensation control circuit is configured to provide the compensation voltage to the driving circuit.

For example, in the pixel circuit provided by at least one embodiment of the present disclosure, the driving circuit is electrically coupled with a first power supply terminal, the compensation control circuit and the light emitting element; the compensation control circuit is electrically coupled with an output terminal of the voltage comparison circuit; the luminance detection circuit is electrically coupled with an input terminal of the voltage comparison circuit; and a second terminal of the light emitting element is electrically coupled with a second power supply terminal.

For example, in the pixel circuit provided by at least one embodiment of the present disclosure, the pixel circuit further comprises a light emitting control circuit, and the light emitting control circuit is configured to control whether to drive the light emitting element to emit light or not.

For example, in the pixel circuit provided by at least one embodiment of the present disclosure, the driving circuit comprises a first transistor, a second transistor and a first capacitor; a control terminal of the first transistor is coupled to a scan line, a first terminal of the first transistor is coupled to a signal line, and a second terminal of the first transistor is coupled to a control terminal of the second transistor and a first terminal of the first capacitor; a first terminal of the second transistor is coupled to the first power supply terminal, and a second terminal of the second transistor is coupled to the light emitting element or the light emitting control circuit; and a second terminal of the first capacitor is coupled to the compensation control circuit.

For example, in the pixel circuit provided by at least one embodiment of the present disclosure, the light emitting control circuit comprises a third transistor, a control terminal of the third transistor is coupled to a light emitting control line, a first terminal of the third transistor is coupled to the second terminal of the second transistor, and a second terminal of the third transistor is coupled to a first terminal of the light emitting element.

For example, in the pixel circuit provided by at least one embodiment of the present disclosure, the compensation control circuit comprises a fourth transistor and a fifth transistor; a control terminal of the fourth transistor is coupled to the scan line, a second terminal of the fourth transistor is coupled to the second terminal of the first capacitor and a first terminal of the fifth transistor, and a first terminal of the fourth transistor is grounded; and a control terminal of the fifth transistor is coupled to a compensation control line, a second terminal of the fifth transistor is coupled to the voltage comparison circuit, and the first terminal of the fifth transistor is coupled to the second terminal of the first capacitor.

For example, in the pixel circuit provided by at least one embodiment of the present disclosure, the luminance detection circuit comprises a photosensitive element and a resistor coupled to the photosensitive element in parallel, a first terminal of the photosensitive element is coupled to an input terminal of the voltage comparison circuit, and a second terminal of the photosensitive element is grounded.

For example, in the pixel circuit provided by at least one embodiment of the present disclosure, the light emitting element is an organic light emitting diode.

At least one embodiment of the present disclosure further provides a display panel, and the display panel comprises the pixel circuit described above.

At least one embodiment of the present disclosure further provides a display device, and the display device comprises the pixel circuit described above or the display panel described above.

At least one embodiment of the present disclosure further provides a driving method of a pixel circuit, and the driving method of the pixel circuit comprises: driving a light emitting element to emit light; detecting luminance of the light emitting element, and obtaining a photosensitive voltage corresponding to the luminance of the light emitting element according to the luminance of the light emitting element; comparing the photosensitive voltage with a reference voltage to obtain a compensation voltage, the reference voltage being a photosensitive voltage obtained in a case that the luminance of the light emitting element is target luminance; and providing the compensation voltage to a driving circuit.

For example, in the driving method of the pixel circuit provided by at least one embodiment of the present disclosure, a value of the photosensitive voltage corresponding to the luminance of the light emitting element is $V_0$, a value of the reference voltage is $V_{ref}$, a value of the compensation voltage provided to the driving circuit is $V_1$, $V_1=r(V_{Ref}-V_0)$, in which r is a compensation coefficient.

At least one embodiment of the present disclosure further provides a pixel circuit, and the pixel circuit comprises a light emitting element, a driving circuit and a compensation voltage acquisition circuit. The driving circuit is configured to drive the light emitting element to emit light; and the compensation voltage acquisition circuit is configured to obtain a compensation voltage based on luminance of the light emitting element, in which the compensation voltage is provided to the driving circuit.

For example, the pixel circuit provided by at least one embodiment of the present disclosure further comprises a compensation control circuit, and the compensation control circuit is configured to provide the compensation voltage to the driving circuit.

For example, the pixel circuit provided by at least one embodiment of the present disclosure further comprises a light emitting control circuit, and the light emitting control circuit is configured to control whether to drive the light emitting element to emit light or not.

For example, in the pixel circuit provided by at least one embodiment of the present disclosure, the light emitting control circuit is electrically coupled to the driving circuit and the light emitting element, and is configured to control whether to provide an electrical signal outputted by the driving circuit to the light emitting element or not.

For example, in the pixel circuit provided by at least one embodiment of the present disclosure, a first terminal of the light emitting element is electrically coupled to the light emitting control circuit or the driving circuit, and a second terminal of the light emitting element is electrically coupled to the second power supply terminal.

For example, in the pixel circuit provided by at least one embodiment of the present disclosure, the driving circuit comprises a driving element, a light emitting selection circuit and a first capacitor. The driving element is configured to be capable of driving the light emitting element to emit light; the light emitting selection circuit is configured to be capable of writing a basic data signal into a control terminal of the driving element; and the first capacitor is configured to be capable of keeping the basic data signal at the control terminal of the driving element.

For example, in the pixel circuit provided by at least one embodiment of the present disclosure, the driving circuit further comprises a first node, the light emitting selection circuit comprises a first transistor, a first terminal of the first transistor is configured to be electrically coupled to the signal line, a second terminal of the first transistor is configured to be electrically coupled to the first node; the driving element comprises a second transistor, a first terminal of the second transistor is configured to be electrically coupled to a first power supply terminal, and a second terminal of the second transistor is configured to be electrically coupled to the light emitting element or the light emitting control circuit; and a first terminal of the first capacitor is configured to be electrically coupled to the first node, and a second terminal of the first capacitor is configured to be electrically coupled to the compensation control circuit.

For example, in the pixel circuit provided by at least one embodiment of the present disclosure, the compensation voltage acquisition circuit comprises a luminance detection circuit and a signal comparison circuit. The luminance detection circuit is configured to detect luminance of the light emitting element to obtain a photosensitive signal corresponding to the luminance of the light emitting element; and the signal comparison circuit is configured to compare the photosensitive signal with a reference signal to obtain the compensation voltage.

For example, in the pixel circuit provided by at least one embodiment of the present disclosure, the luminance detection circuit comprises a photosensitive element and a first resistor, the photosensitive element is configured to convert light incident onto the photosensitive element into a photosensitive current signal, the first resistor is configured to convert the photosensitive current signal into a photosensitive voltage signal; the signal comparison circuit comprises a first input terminal, a second input terminal and a signal output terminal, the first input terminal is configured to receive a reference voltage signal, the second input terminal is configured to receive the photosensitive voltage signal, and the signal output terminal is configured to output the compensation voltage obtained based on the reference voltage signal and the photosensitive voltage signal.

For example, in the pixel circuit provided by at least one embodiment of the present disclosure, the signal comparison circuit is a voltage comparison circuit, the voltage comparison circuit comprises a sixth transistor, a seventh transistor, an eighth transistor, a second resistor, and a third node; a first terminal of the sixth transistor is configured to be electrically coupled to a first high voltage source, a second terminal of the sixth transistor is configured to be electrically coupled to the third node, and a control terminal of the sixth transistor is configured as the first input terminal; a first terminal of the seventh transistor is configured to be electrically coupled to the third node, a second terminal of the seventh transistor is configured to be electrically coupled to a first low voltage source $V_{L1}$, and a control terminal of the seventh transistor is configured as the second input terminal; a first terminal of the eighth transistor is configured to be electrically coupled to a second high voltage source, a second terminal of the eighth transistor is configured as the signal output terminal, and a control terminal of the eighth transistor is configured to be electrically coupled to the third node; a first terminal of the second resistor is configured to be electrically coupled to the second terminal of the eighth transistor, and a second terminal of the second resistor is configured to be electrically coupled to a second low voltage source; a voltage value of the first high voltage source is greater than a voltage value of the first low voltage source, a voltage value of the second high voltage source is greater than a voltage value of the second low voltage source.

For example, in the pixel circuit provided by at least one embodiment of the present disclosure, the compensation control circuit comprises an initial voltage providing circuit and a compensation voltage providing circuit, the initial voltage providing circuit is configured to provide an initial voltage to the driving circuit; and the compensation voltage providing circuit is configured to provide the compensation voltage to the driving circuit.

For example, in the pixel circuit provided by at least one embodiment of the present disclosure, the pixel circuit further comprises a second node, a second terminal of the first capacitor is configured to be electrically coupled to the second node; the initial voltage providing circuit comprises a fourth transistor, a first terminal of the fourth transistor is electrically coupled to a third power supply terminal, and a second terminal of the fourth transistor is electrically coupled to the second node; the compensation voltage providing circuit comprises a fifth transistor, a first terminal of the fifth transistor is electrically coupled to the second node, and a second terminal of the fifth transistor is electrically coupled to the output terminal of the signal comparison circuit.

At least one embodiment of the present disclosure further provides a driving method of a pixel circuit, and the driving method of the pixel circuit comprises: driving a light emitting element to emit light; obtaining a compensation voltage based on luminance of the light emitting element, in which the compensation voltage is provided to the driving circuit.

For example, in the driving method of the pixel circuit provided by at least one embodiment of the present disclosure, the driving method further comprises: providing the compensation voltage to the driving circuit.

For example, in the driving method of the pixel circuit provided by at least one embodiment of the present disclosure, the driving method further comprises: controlling whether to provide an electrical signal outputted by the driving circuit to the light emitting element or not.

For example, in the driving method of the pixel circuit provided by at least one embodiment of the present disclosure, obtaining of the compensation voltage based on the luminance of the light emitting element comprises: detecting the luminance of the light emitting element to obtain a photosensitive signal corresponding to the luminance of the light emitting element; and comparing the photosensitive signal with a reference signal to obtain the compensation voltage.

An embodiment of the present disclosure provides a pixel circuit and a driving method thereof, a display panel and a display device, so as to implement a luminance compensation function.

BRIEF DESCRIPTION OF THE DRAWINGS

In order to clearly illustrate the technical solutions of the embodiments of the disclosure, the drawings required for describing the embodiments or related technologies will be briefly described in the following; it is obvious that the described drawings are only related to some embodiments of the present disclosure and thus are not limitative to the present disclosure.

REFERENCE NUMERALS

C—storage capacitor; 1—light emitting element; 2—driving circuit; 3—luminance detection circuit; 4—voltage comparison circuit; 5—compensation control circuit; 6—light emitting control circuit; 21—driving element; 22—light emitting selection circuit; 30—compensation voltage acquisition circuit; 31—photosensitive element; 51—initial voltage providing circuit; 52—compensation voltage providing circuit; 71—first node; 72—second node; 73—third node; C1—first capacitor; R1—first resistor; R2—second resistor; Q1—first transistor; Q2—second transistor; Q3—third transistor; Q4—fourth transistor; Q5—fifth transistor; Q6—sixth transistor; Q7—seventh transistor; Q8—eighth transistor; S1—light emitting control line; S2—compensation control line; VDD—first power supply terminal; VSS—second power supply terminal; VD1—third power supply terminal.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
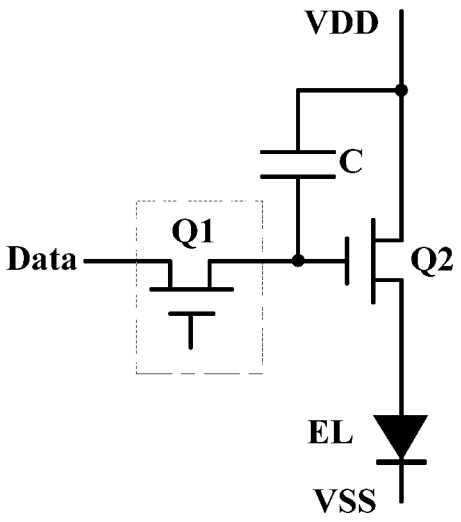
FIG. 1 is a schematically structural view of a pixel circuit.

For example, FIG. 1 is a schematically structural view of a pixel circuit, the pixel circuit illustrated in FIG. 1 is a 2T1C circuit, that is, a basic function of driving a light emitting element EL (for example, an OLED) to emit light is achieved by two TFTs (thin film transistors) and one storage capacitor (C).

For example, as illustrated in FIG. 1, a 2T1C-type pixel circuit can comprise a first transistor Q1 (i.e., a selection transistor), a second transistor Q2 (i.e., a driving transistor), and a storage capacitor C. For example, a control terminal of the first transistor Q1 can receive a scan signal, a first terminal of the first transistor Q1 can be electrically coupled to (for example, electrically connected to) a signal line Data to receive a data signal, and a second terminal of the first transistor Q1 can be electrically coupled to a control terminal of the second transistor Q2. For example, a first terminal of the second transistor Q2 can be electrically coupled to a first power supply terminal VDD, for example, the first power supply terminal VDD can be a voltage source to output a constant positive voltage, or the first power supply terminal VDD also can be a current source or the like; a second terminal of the second transistor Q2 can be electrically coupled to a first terminal (such as, a positive terminal of the OLED)of the light emitting element EL. For example, a first terminal of the storage capacitor is electrically coupled to the first terminal of the second transistor Q2 and the first power supply terminal VDD, and a second terminal of the storage capacitor is electrically coupled to the second terminal of the first transistor Q1 and the control terminal of the second transistor Q2. A second terminal of the light emitting element EL (such as, a negative terminal of the OLED) is electrically coupled to a second power supply terminal VSS, for example, the second power supply terminal VSS can be a ground terminal.

For example, a driving method of the 2T1C-type pixel circuit comprises controlling of grayscales of pixels through the two TFTs and the storage capacitor C. In a case that a scan signal is applied through a scan line to turn on the first transistor Q1, a data driving circuit charges the storage capacitor C through the first transistor Q1 by a data voltage sent by the signal line, so as to store the data voltage in the storage capacitor C, and the stored data voltage controls the conducting degree of the second transistor Q2,so as to control the value of the current, which is flowed through the second transistor Q2 and for driving the light emitting element EL (such as, the OLED) to emit light, that is, the current determines the gray scale of the emitted light of the pixel The inventors have noticed that an operating temperature of the pixel circuit or the aging degree of the light emitting element EL and/or a transistor (for example, the second transistor Q2) and the like can affect the value of the current, which is flowed through the second transistor Q2 and for driving the light emitting element EL (such as, the OLED) to emit light, such that the light emitting luminance of the pixel circuit is deviated from a predetermined luminance value (for example, higher or lower than the predetermined luminance value), and as a result, the quality of the display image is degraded, and the experience of users is affected.

For example, the transistors can be classified into N-type transistors and P-type transistors according to the characteristics of the transistors. For clarity, the embodiments of the present disclosure illustrate the technical solution of the present disclosure in detail by taking a case that the transistors are P-type transistors as an example. However, transistors in the embodiments of the present disclosure are not limited to be P-type transistors, and one of ordinary skill in the art also can adopt N-type transistors to implement one or more of the transistors in the embodiments of the present disclosure according to actual requirements. These transistors are, for example, thin film transistors.

At least one embodiment of the present disclosure provides a pixel circuit, and the pixel circuit comprises a light emitting element, a driving circuit and a compensation voltage acquisition circuit. The driving circuit is configured to drive the light emitting element to emit light; and the compensation voltage acquisition circuit is configured to obtain a compensation voltage based on luminance of the light emitting element, the compensation voltage is provided to the driving circuit.

At least one embodiment of the present disclosure further provides a display panel, and the display panel comprises the pixel circuit described above. At least one embodiment of the present disclosure further provides a display device, and the display device comprises the pixel circuit described above or the display panel described above.

At least one embodiment of the present disclosure further provides a driving method of a pixel circuit, and the driving method of the pixel circuit comprises: driving a light emitting element to emit light; obtaining a compensation voltage based on luminance of the light emitting element; and providing the compensation voltage to a driving circuit.

Non-limitative descriptions will be given below to the pixel circuit, the driving method thereof and the display device according to the embodiment of the present disclosure with reference to a plurality of embodiments, as described below, in a case of no conflict, different features of these specific embodiments can be combined with each other to obtain new embodiments, and these new embodiment fall within the scope of the present disclosure.

First Embodiment

Figure 2:
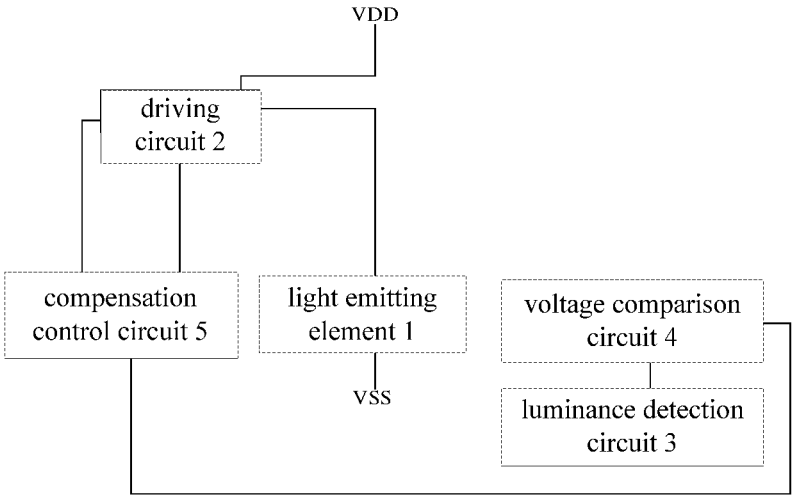
FIG. 2 is a schematically structural view of a pixel circuit provided by a first embodiment of the present disclosure.

The present embodiment provides a pixel circuit, as illustrated in FIG. 2, the pixel circuit can comprises: a light emitting element 1, a driving circuit 2, a luminance detection circuit 3, a voltage comparison circuit 4 and a compensation control circuit 5. The driving circuit 2 is configured to drive the light emitting element 1 to emit light; the luminance detection circuit 3 is configured to detect luminance of the light emitting element 1, and obtain a photosensitive voltage corresponding to the luminance of the light emitting element 1 according to the luminance of the light emitting element 1; the voltage comparison circuit 4 is configured to compare the photosensitive voltage with a reference voltage to obtain a compensation voltage, in which the reference voltage is a photosensitive voltage obtained by the luminance detection circuit 3 in a case that the luminance of the light emitting element is target luminance; and the compensation control circuit 5 is configured to provide the compensation voltage to the driving circuit 2.

For example, for the luminance detection circuit 3, the voltage comparison circuit 4 and the compensation control circuit 5 provided in the pixel circuit of the present embodiment, the luminance detection circuit 3 can convert light incident onto the luminance detection circuit 3 into the photosensitive voltage and provide the photosensitive voltage to the voltage comparison circuit 4, and then the voltage comparison circuit 4 can compare the photosensitive voltage with the reference voltage and can obtain the compensation voltage. The compensation control circuit 5 can provide the compensation voltage to the driving circuit 2, the driving circuit 2 can adjust (for example, adjust in real time) a current provided to the light emitting element 1 according to the compensation voltage, so that the luminance of the light emitting element 1 can be adjusted (for example, the luminance of the light emitting element 1 can be adjusted to the target luminance), and deviation of the luminance of the light emitting element 1 (such as, an OLED)from the target luminance value can be prevented, and therefore the display quality of the display device including the pixel circuit can be improved.

Second Embodiment

The present embodiment provides a pixel circuit, and the pixel circuit 100, for example, can be applied to a display panel, such as an OLED display panel. For example, FIG. 3A is an exemplary block diagram of a pixel circuit provided by a second embodiment of the present disclosure, and FIG. 3B is an exemplary structural view of the pixel circuit 100 illustrated in FIG. 3A.

Figure 3A:
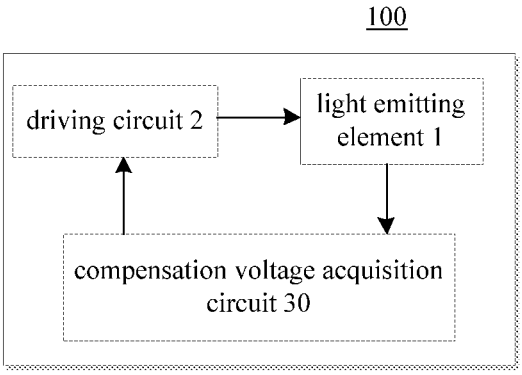
FIG. 3A is an exemplary block diagram of a pixel circuit provided by a second embodiment of the present disclosure.

For example, as illustrated in FIG. 3A, the pixel circuit 100 can comprise a light emitting element 1, a driving circuit 2 and a compensation voltage acquisition circuit 30. For example, the driving circuit 2 can be configured to drive the light emitting element 1 to emit light; and the compensation voltage acquisition circuit 30 can be configured to obtain a compensation voltage based on luminance of the light emitting element 1, in which the compensation voltage can be provided to the driving circuit 2.

Figure 3B:
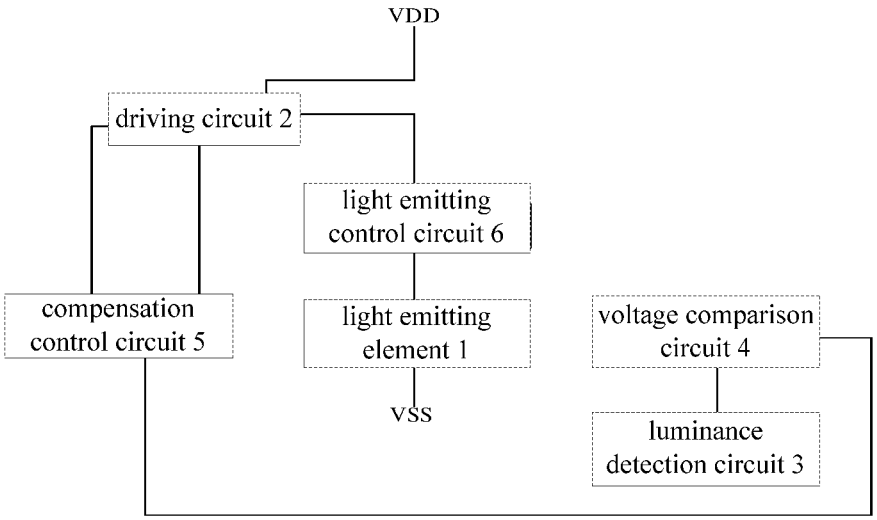
FIG. 3B is an exemplary structural view of the pixel circuit illustrated in FIG. 3A.

For example, according to specific application requirements, the pixel circuit 100 can comprise a light emitting control circuit 6 (referring to FIG. 3B). For example, the light emitting control circuit is configured to control whether to drive the light emitting element to emit light or not. For example, a specific position of the light emitting control circuit can beset according to specific application requirements, no specific limitation will be given to the embodiment of the present disclosure. For example, the light emitting control circuit 6 can be electrically coupled to the driving circuit 2 or/and the light emitting element 1. For example, the light emitting control circuit 6 can be disposed between the driving circuit 2 and a first power supply terminal VDD. For another example, the light emitting control circuit 6 also can be disposed between the light emitting element 1 and a second power supply terminal VSS. For yet another example, the light emitting control circuit 6 also can be disposed between the driving circuit 2 and the light emitting element 1. Thus, the light emitting control circuit 6 can be configured to control whether to drive the light emitting element 1 to emit light or not, and the light emitting control circuit 6 can control whether or not the light emitting element 1 to emit light, for example, by controlling whether or not to provide an electrical signal (such as, a current signal) outputted from the driving circuit 2 to the light emitting element 1. For example, concrete descriptions will be given below to the embodiment of the present disclosure by taking a case that the light emitting control circuit 6 is disposed between the driving circuit 2 and the light emitting element 1 an example, but the embodiment of the present disclosure is not limited thereto.

Figure 4A:
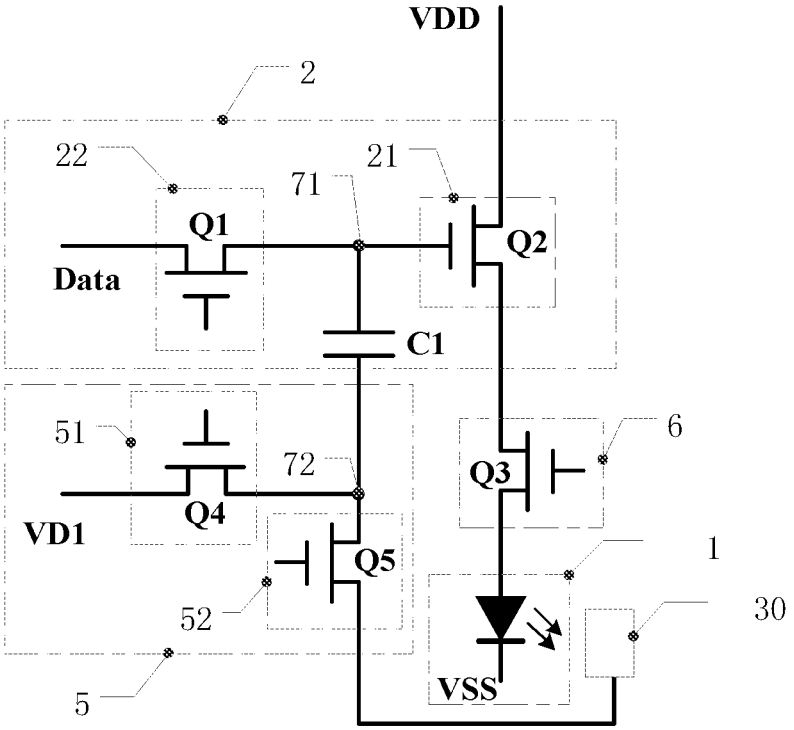
FIG. 4A is an exemplary circuit diagram of the pixel circuit illustrated in FIG. 3A.
Figure 4B:
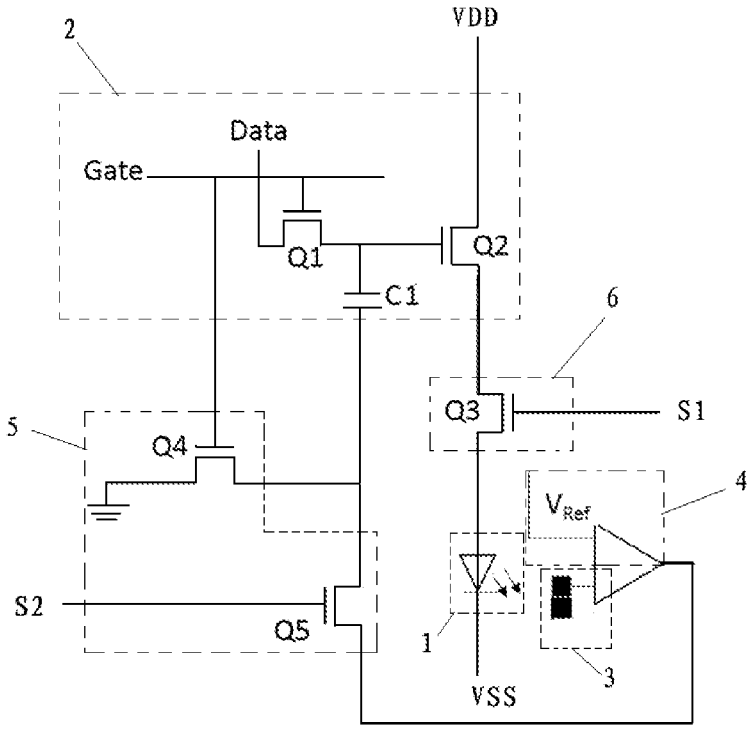
FIG. 4B is a specific implementation of the circuit diagram of the pixel circuit illustrated in FIG. 4A.

For example, specific structures of the light emitting element 1, the driving circuit 2, the compensation voltage acquisition circuit 30 and the light emitting control circuit 6 can be set according to specific application requirements, no specific limitation will be given to the embodiment of the present disclosure. For example, the pixel circuit 100 provided by the second embodiment can be implemented as a circuit as illustrated in FIG. 4A. For example, FIG. 4B is a specific implementation of the pixel circuit 100 illustrated in FIG. 4A, however the circuit illustrated in FIG. 4A is not limited to the specific implementation illustrated in FIG. 4B.

For example, the light emitting element 1 can be a current-driven light emitting element 1 such as a LED (light emitting diode) or an OLED (organic light emitting diode), but the embodiment of the present disclosure is not limited thereto. For example, descriptions of the technical solution of the present disclosure will be given below to the embodiment of the present disclosure by taking a case that the light emitting element 1 is an OLED as an example, but the light emitting element 1 of the present disclosure is not limited to the OLED. For example, as illustrated in FIG. 4A, a second terminal (for example, a cathode terminal) of the light emitting element 1 can be coupled to the second power supply terminal VSS. For example, the second power supply terminal VSS can output a constant voltage, the second power supply terminal VSS for example can be grounded, but the embodiment of the present disclosure is not limited thereto.

For example, as illustrated in FIG. 4A, the driving circuit 2 can comprise a driving element 21, a light emitting selection circuit 22 and a first capacitor C1. For example, as illustrated in FIG. 4A, the driving element 21 is configured to be capable of driving the light emitting element 1 to emit light. For example, the light emitting selection circuit 22 is configured to be capable of writing a basic data signal into a control terminal of the driving element 21. For example, the first capacitor C1 is configured to be capable of keeping the basic data signal at the control terminal of the driving element 21. For example, the specific forms of the driving element 21, the light emitting selection circuit 22 and the first capacitor C1 can be set according to specific application requirements, no specific limitation will be given to the embodiment of the present disclosure.

For example, as illustrated in FIG. 4A, the driving circuit 2 can further comprise a first node 71. For example, as illustrated in FIG. 4A, the light emitting selection circuit 22 can comprise a first transistor Q1. For example, a first terminal of the first transistor Q1 is configured to be electrically coupled to a signal line Data, a second terminal of the first transistor Q1 is configured to be electrically coupled to the first node 71, and a control terminal of the first transistor Q1 is configured to be electrically coupled to a scan line, the scan line can be, for example, a gate line (such as, a gate line Gate illustrated in FIG. 4B). For example, as illustrated in FIG. 4B,on and off of the first transistor Q1 can be controlled by a signal (such as, a turn-on signal or a turn-off signal) provided by the scan line.

For example, as illustrated in FIG. 4A,the driving element 21 can comprise a second transistor Q2. For example, a first terminal of the second transistor Q2 is configured to be electrically coupled to the first power supply terminal VDD, the first power supply terminal VDD, for example, can output a constant voltage, the voltage outputted by the first power supply terminal VDD can be, for example, greater than the voltage outputted by the second power supply terminal VSS, but the embodiment of the present disclosure is not limited thereto. For example, a second terminal of the second transistor Q2 is configured to be electrically coupled to the light emitting element 1 or the light emitting control circuit 6. For example, in a case that the pixel circuit 100 further comprises the light emitting control circuit 6, the second terminal of the second transistor Q2 is configured to be electrically coupled to the light emitting control circuit 6; for another example, in a case that the pixel circuit 100 does not comprise the light emitting control circuit 6, the second terminal of the second transistor Q2 is configured to be electrically coupled to the light emitting element 1. For example, a control terminal of the second transistor Q2 is configured to be electrically coupled to the first node 71. For example, as illustrated in FIG. 4A,a first terminal of the first capacitor C1 is configured to be electrically coupled to the first node 71, and a second terminal of the first capacitor C1 is coupled to the compensation control circuit 5.

For example, as illustrated in FIG. 4A, in a case that the control terminal of the first transistor Q1 receives the turn-on signal (such as, a low voltage signal), the basic data signal (such as, $V_{Data}$) provided by the signal line Data can be written into the first node 71 (i.e., the control terminal of the driving element 21 and the first terminal of the first capacitor C1) through the first transistor Q1 in turn-on state. For example, the first capacitor C1 is configured to be capable of keeping the basic data signal at the control terminal of the driving element 21, so as to allow the driving element 21 to be in turn-on state according to actual requirements. For example, a voltage (such as, $V_{Data}$) of the control terminal of the second transistor Q2 can control the conducting degree of the second transistor Q2, and therefore can control the value of the driving current provided by the driving circuit 2 to the light emitting element 1, so as to determine the luminance of the light emitting element 1 and the gray scale of the emitted light of the pixel circuit 100.

For example, as illustrated in FIG. 4A and FIG. 4B, in the case that the pixel circuit 100 comprises the light emitting control circuit 6, the light emitting control circuit 6 can comprise a third transistor Q3. For example, a second terminal of the third transistor Q3 is electrically coupled to the first terminal (such as, an anode terminal) of the light emitting element 1, and a first terminal of the third transistor Q3 is electrically coupled to an output terminal of the driving circuit 2 (i.e., the second terminal of the second transistor Q2). For example, as illustrated in FIG. 4B, the on and off of the third transistor Q3 can be controlled by a signal provided by alight emitting control line S1. For example, when the light emitting control circuit 6 receives a turned-on signal (such as, a low voltage signal), an electrical signal (such as, a current signal) outputted by the driving circuit 2 can be provided to the light emitting element 1 through the light emitting control circuit 6 in conducting state, so as to allow the light emitting element 1 to emit light. When the third transistor Q3 is turned off, no driving current flows through the light emitting element 1, so the light emitting element 1 does not emit light.

For example, descriptions of the technical solution of the present disclosure will be given below by taking a case that the pixel circuit 100 comprises the light emitting control circuit 6 as an example, however, the pixel circuit 100 of the present embodiment can also not comprise the light emitting control circuit 6, and in such a case, the first terminal of the light emitting element 1 can be directly electrically coupled to the output terminal of the driving circuit 2.

For example, the pixel circuit 100 provided by the embodiment of the present disclosure can obtain a compensation voltage by the compensation voltage acquisition circuit 30 based on the luminance of the light emitting element 1, and specific descriptions of the compensation voltage acquisition circuit 30 provided by the embodiment of the present disclosure is provided below in conjunction with FIG. 4A, FIG. 4B and FIG. 5.

For example, the compensation voltage acquisition circuit 30 can comprise a luminance detection circuit 3 and a signal comparison circuit. For example, as illustrated in FIG. 4A and FIG. 4B, the luminance detection circuit 3 can be configured to detect the luminance of the light emitting element 1, so as to obtain a photosensitive signal corresponding to the luminance of the light emitting element 1. For example, the photosensitive signal can be a voltage signal or a current signal; no specific limitation will be given to the embodiment of the present disclosure. For example, the signal comparison circuit can be configured to compare the photosensitive signal with a reference signal to obtain the compensation voltage. For example, the signal comparison circuit can obtain the compensation voltage by comparing the voltages or the currents, no specific limitation will be given to the embodiment of the present disclosure.

For example, the reference signal can be a photosensitive signal obtained by the luminance detection circuit 3 in a case that the luminance of the light emitting element 1 is target luminance, but the embodiment of the present disclosure is not limited thereto. For example, because a display device including the pixel circuit 100 needs to display different images in different image frames, the target luminance of the light emitting element 1 is constantly changed with time, so that the reference signal is constantly changed accordingly.

For example, specific forms of the luminance detection circuit 3 and the signal comparison circuit can be set according to the specific application requirements, no specific limitation will be given to the embodiment of the present disclosure. For example, concrete descriptions of the pixel circuit 100 provided by the embodiment of the present disclosure will be given below by taking a case that the signal comparison circuit is the voltage comparison circuit 4 as an example, but the embodiment of the present disclosure is not limited thereto.

Figure 5A:
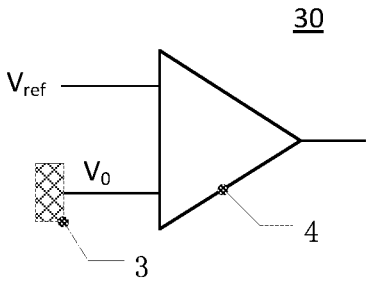
FIG. 5A is an exemplary structural view of a compensation voltage acquisition circuit provided by a second embodiment of the present disclosure.

For example, FIG. 5A is an exemplary structural view of a compensation voltage acquisition circuit 30 provided by the second embodiment of the present disclosure. For example, as illustrated in FIG. 5A, the compensation voltage acquisition circuit 30 comprises the voltage comparison circuit 4 and the luminance detection circuit 3.

Figure 5B:
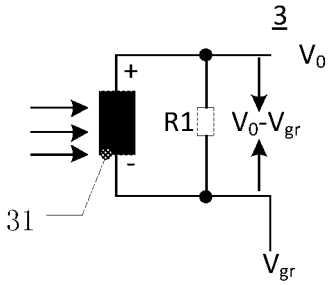
FIG. 5B is an exemplary circuit diagram of a luminance detection circuit provided by a second embodiment of the present disclosure.

For example, the luminance detection circuit 3 can be implemented as a circuit illustrated in FIG. 5B. For example, as illustrated in FIG. 5B, the luminance detection circuit 3 can comprise a photosensitive element 31 and a first resistor R1. For example, the photosensitive element 31 is configured to convert light incident onto the photosensitive element 31 into a photosensitive current signal, the photosensitive element 31 can be, for example, a photodiode (a PN junction) or a transistor, but the embodiment of the present disclosure is not limited thereto, the photosensitive element 31 can be any element which can convert an optical signal incident onto the photosensitive element 31 into an electrical signal (such as, a current signal). For example, the first capacitor R1 is configured to convert the photosensitive current signal into a photosensitive voltage signal, and a specific form of the first capacitor R1 can beset according to the specific application requirements, no specific limitation will be given to the embodiment of the present disclosure.

For example, as illustrated in FIG. 5B, the first resistor R1 can be connected in parallel with the photosensitive element 31, in such a case, the voltage difference $V_0-V_{gr}$ between two terminals of the first resistor R1 is proportional to the current outputted by the photosensitive element 31, that is, the voltage difference $V_0-V_{gr}$ between two terminals of the first resistor R1 is proportional to the intensity (i.e., the luminance of the light emitting element 1) of the light incident onto the photosensitive element 31. For example, one terminal (such as, a terminal corresponding to a positive electrode of the photosensitive element 31) of the luminance detection circuit 3 can be configured as an output terminal, and the other terminal (such as, a terminal corresponding to a negative electrode of the photosensitive element 31) of the luminance detection circuit 3 can be coupled to a constant voltage source $V_{gr}$, a voltage provided by the constant voltage source $V_{gr}$ can be 0 volt (namely, the other terminal of the luminance detection circuit 3 is grounded), but the embodiment of the present disclosure is not limited thereto. Therefore, the luminance detection circuit 3 illustrated in FIG. 5B can detect the luminance of the light emitting element 1, and can acquire the photosensitive signal $V_0$ corresponding to the luminance of the light emitting element 1. For example, a connection between the first resistor R1 and the photosensitive element 31 is not limited to parallel connection, according to specific application requirements, the first resistor R1, for example, also can be connected in series with the photosensitive element 31, no specific limitation will be given to the embodiment of the present disclosure.

For example, as illustrated in FIG. 5A, the voltage comparison circuit 4 can comprise a first input terminal, a second input terminal and a signal output terminal. For example, the first input terminal is configured to receive a reference voltage signal. For example, the second input terminal can be electrically coupled with the luminance detection circuit 3, and can be configured to receive the photosensitive voltage signal. For example, the signal output terminal can be configured to output the compensation voltage obtained based on the reference voltage signal and the photosensitive voltage signal.

For example, a specific implementation of the voltage comparison circuit 4 can beset according to specific application requirements, no specific limitation will be given to the embodiment of the present disclosure. For example, the voltage comparison circuit 4 can be implemented as a circuit illustrated in FIG. 5C.

Figure 5C:
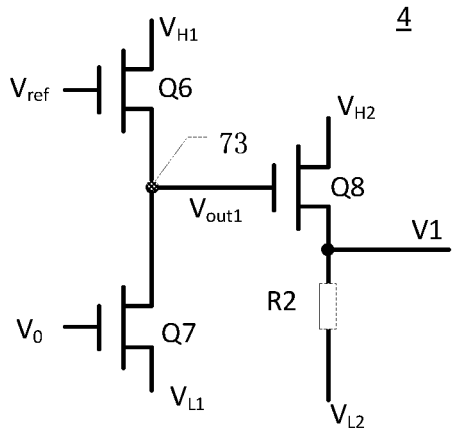
FIG. 5C is an exemplary circuit diagram of a voltage comparison circuit provided by a second embodiment of the present disclosure.

For example, as illustrated in FIG. 5C, the voltage comparison circuit 4 can comprise a sixth transistor Q6, a seventh transistor Q7, an eighth transistor Q8, a second resistor R2, and a third node 73. For example, a first terminal of the sixth transistor Q6 can be electrically coupled to a first high voltage source $V_{H1}$, a second terminal of the sixth transistor Q6 can be electrically coupled to the third node 73, and a control terminal of the sixth transistor Q6 can receive the reference voltage $V_{Ref}$. For example, a first terminal of the seventh transistor Q7 can be electrically coupled to the third node 73, a second terminal of the seventh transistor Q7 can be electrically coupled to a first low voltage source $V_{L1}$, and a control terminal of the seventh transistor Q7 can receive the photosensitive voltage $V_0$. For example, a first terminal of the eighth transistor Q8 can be electrically coupled to a second high voltage source $V_{H2}$, a second terminal of the eighth transistor Q8 can be electrically coupled to a first terminal of the second resistor R2 and an output signal line of the voltage comparison circuit 4, and a control terminal of the eighth transistor Q8 can be electrically coupled to the third node 73. For example, a second terminal of the second resistor R2 can be electrically coupled to a second low voltage source $V_{L2}$, and a voltage of the second low voltage source $V_{L2}$can be, for example, 0V (that is, the second terminal of the second resistor R2 is grounded). For example, a voltage value of the first high voltage source $V_{H1}$can be greater than a voltage value of the first low voltage source $V_{L1}$, and a voltage value of the second high voltage source $V_{H2}$can be greater than a voltage value of the second low voltage source $V_{L2}$. For example, the voltage value of the first high voltage source $V_{H1}$, the voltage value of the first low voltage source $V_{L1}$, the voltage value of the second high voltage source $V_{H2}$ and the voltage value of the second low voltage source $V_{L2}$can be set according to specific application requirements, no specific limitation will be given to the embodiment of the present disclosure.

For example, following equations can be obtained according to transistor characteristics:

$$V_0-V_{L1}=V_{Ref}-V_{out1};$$

$$V_1=I_{ds}\times R_2+V_{L2}$$

$$=\tfrac{1}{2}\times K\times R_2(V_{gs}-V_{th})^2+V_{L2}$$

$$=\tfrac{1}{2}\times K\times R_2(V_{out1}-V_{H2}-V_{th})^2+V_{L2}$$

$$=\tfrac{1}{2}\times K\times R_2\,(V_{Ref}-V_0+V_{L1}-V_{H2}-V_{th})^2+V_{L2}$$

Here, $I_{ds}$ is an output current of the eighth transistor Q8 being in a saturated state; K=W/L×C×u, W/L is a width-to-length ratio (i.e., the ratio of the width to the length) of a channel of the eighth transistor Q8, u is electron mobility, C is capacitance per unit area, and $V_{th}$ is the threshold voltage of the eighth transistor Q8.

For example, voltages of the first high voltage source $V_{H1}$, the first low voltage source $V_{L1}$, the second high voltage source $V_{H2}$ and the second low voltage source $V_{L2}$can be set in advance, and the threshold voltage $V_{th}$ of the eighth transistor Q8 can be measured in advance. For example, $V_{L1}-V_{H2}-V_{th}$ and $V_{L2}$ can be set to zero respectively according to specific application requirements. In such a case, the compensation voltage $V_1$ outputted by the voltage comparison circuit 4 satisfies the following formula:

$$V_1=r(V_{Ref}-V_0),$$

where r is a compensation coefficient, and $$r=\tfrac{1}{2}\times K\times R_2.$$

For example, specific values of the eighth transistor Q8 and the second resistor R2 can be set according to specific application requirements, no specific limitation will be given to the embodiment of the present disclosure, provided that a light emitting circuit for the light emitting element 1 can be compensated by the obtained compensation voltage $V_1$ (for example, the luminance of the light emitting element after being compensated is the target luminance).

For example, in a case that the photosensitive voltage signal $V_0$ outputted by the luminance detection circuit 3 is equal to the reference voltage $V_{Ref}$ (that is, the luminance of the light emitting element 1 is the target luminance), the compensation voltage $V_1$ outputted by the voltage comparison circuit 4 is equal to 0. For example, in a case that the photosensitive voltage signal $V_0$ outputted by the luminance detection circuit 3 is not equal to the reference voltage $V_{Ref}$ (that is, the luminance of the light emitting element 1 is not equal to the target luminance), the compensation voltage $V_1$ outputted by the voltage comparison circuit 4 is $V_1=r(V_{Ref}-V_0)$, the compensation voltage $V_1$ can be provided to the driving circuit 2 to compensate (such as, compensate in real time) the luminance of the light emitting element 1 (that is, the luminous intensity of the light emitting element 1).

For example, according to specific application requirements, the pixel circuit 100 provided by the embodiments of the present disclosure can further comprise a compensation control circuit 5. For example, the compensation control circuit 5 can be configured to provide the compensation voltage to the driving circuit 2. For example, a specific form of the compensation control circuit 5 can beset according to specific application requirements, no specific limitation will be given to the embodiment of the present disclosure. For example, the compensation control circuit 5 can be implemented as a circuit illustrated in FIG. 4A.

For example, the compensation control circuit 5 provided by the present disclosure will be detailedly described below in conjunction with FIG. 4A and FIG. 4B. For example, as illustrated in FIG. 4A, the compensation control circuit 5 can comprise an initial voltage providing circuit 51 and a compensation voltage providing circuit 52. For example, the initial voltage providing circuit 51 can be configured to provide an initial voltage to the driving circuit 2; and the compensation voltage providing circuit 52 can be configured to provide the compensation voltage to the driving circuit 2. For example, specific forms of the initial voltage providing circuit 51 and the compensation voltage providing circuit 52 can beset according to specific application requirements, no specific limitation will be given to the embodiment of the present disclosure.

For example, as illustrated in FIG. 4A,the pixel circuit 100 further comprises a second node 72. For example, a second terminal of the first capacitor C1 is configured to be electrically coupled to the second node 72.

For example, as illustrated in FIG. 4A, the initial voltage providing circuit 51 can comprise a fourth transistor Q4. For example, a first terminal of the fourth transistor Q4 is electrically coupled to a third power supply terminal VD1, the third power supply terminal VD1 can provide a constant voltage, and the voltage value of the constant voltage VD1 can be, for example, 0V (referring to FIG. 4B), but the embodiment of the present disclosure is not limited thereto. For example, a control terminal of the fourth transistor Q4 can be electrically coupled to a scan line (such as, a gate line). For example, as illustrated in FIG. 4B, a scan line electrically coupled to the control terminal of the fourth transistor Q4 and a scan line electrically coupled to the control terminal of the first transistor Q1 can be same one scan line, so that the pixel circuit 100 provided by the embodiment can be simplified, but the embodiment of the present disclosure is not limited thereto. For example, a second terminal of the fourth transistor Q4 is configured to be electrically coupled to the second node 72.

For example, in a case that the control terminal of the fourth transistor Q4 receives a turn-on signal (such as, a low voltage signal),a voltage VD1 provided by the third power supply terminal VD1 can be written into the second node 72, that is, the second terminal of the first capacitor C1. For example, the control terminal of the fourth transistor Q4 and the control terminal of the first transistor Q1 can receive turn-on signals at the same time, in such a case, the basic data signal (such as, $V_{Data}$) provided by the signal line Data and the voltage VD1 provided by the third power supply terminal VD1 can be respectively written into the first terminal and the second terminal of the first capacitor C1. Therefore, the voltage difference between two terminals of the first capacitor C1 is $V_{Data}$−VD1, and the voltage difference $V_{Data}$−VD1 is stored in the first capacitor C1. For example, as illustrated in FIG. 4B, in a case that the third power supply terminal VD1 is grounded (VD1=0), the voltage difference stored at both terminals of the first capacitor C1 is $V_{Data}$. For example, concrete descriptions of the compensation control circuit 5 provided by the embodiment of the present disclosure will be given below by taking a case that the third power supply terminal VD1 is grounded as an example, but the embodiment of the present disclosure is not limited thereto.

For example, as illustrated in FIG. 4A, the compensation voltage providing circuit 52 can comprise a fifth transistor Q5. For example, as illustrated in FIG. 4A, a first terminal of the fifth transistor Q5 is electrically coupled to the second node 72, and a second terminal of the fifth transistor Q5 is electrically coupled to the output terminal of the signal comparison circuit. For example, as illustrated in FIG. 4B, a control terminal of the fifth transistor Q5 can be electrically coupled to a compensation control line S2. For example, when the fifth transistor Q5 is turned on, the compensation voltage $V_1$ outputted by the signal comparison circuit can be provided to the driving circuit 2 through the fifth transistor Q5 in turned on state and the first capacitor C1.

Figure 6:
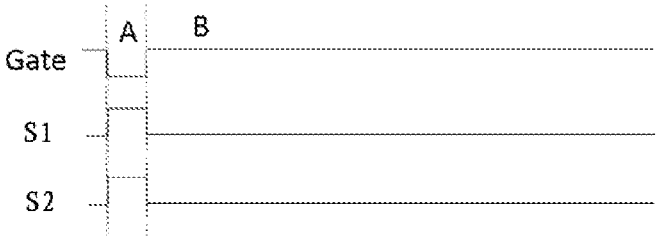
FIG. 6 is an exemplary driving timing diagram of the pixel circuit illustrated in FIG. 4B of the present disclosure.

For example, voltage compensation function of the compensation control circuit 5 provided by the embodiment of the present disclosure will be exemplarily described below in conjunction with FIG. 4B and FIG. 6. For example, FIG. 6 is an exemplary driving timing diagram of the pixel circuit illustrated in FIG. 4B. For example, a driving period of the pixel circuit 100 (for example, the driving period can correspond to a display period of a display device including the pixel circuit 100, that is, the driving period corresponds to display time of a frame of image) comprises a charging phase A and a compensation light-emitting phase B.

For example, in the charging phase A, the scan line, for example, can provide low voltage level, the light emitting control line S1 and the compensation control line S2, for example, can provide high voltage level, in such a case, the first transistor Q1 and the fourth transistor Q4 are turned on, and the third transistor Q3 and the fifth transistor Q5 are turned off. For example, a voltage of the first terminal of the fourth transistor Q4 can be written into the second terminal of the first capacitor C1 through the fourth transistor Q4 in turn-on state; in a case that the first terminal of the fourth transistor Q4 is grounded, the voltage of the second terminal of the first capacitor C1 is 0; the voltage $V_{Data}$ provided by the signal line can be written into the first node 71 (that is, the first terminal of the first capacitor C1 and the control terminal of the second transistor Q2) through the first transistor Q1 in turn-on state; in such a case, the voltage difference between two terminals of the first capacitor C1 is $V_{Data}$, and the voltage difference $V_{Data}$ is stored in the first capacitor C1. For example, according to specific application requirements, in the charging phase A, the third transistor Q3 also can be in a turned-on state, so that the pixel circuit 100 can obtain the compensation voltage during the charging phase A.

For example, in the compensation light-emitting phase B, the scan line, for example, can provide high voltage level, the light emitting control line S1 and the compensation control line S2, for example, can provide low voltage level, in such a case, the first transistor Q1 and the fourth transistor Q4 are turned off, and the third transistor Q3 and the fifth transistor Q5 are turned on.

For example, in the compensation light-emitting phase B, because the third transistor Q3 is turned on, a driving electrical signal (such as, a driving current signal) outputted by the second transistor Q2 can be provided to the light emitting element 1 through the third transistor Q3 in turn-on state, and the value of the driving current determines the luminance of the light emitting element 1. For example, the compensation voltage acquisition circuit 30 can acquire the compensation voltage based on the luminance of the light emitting element 1, and provide the compensation voltage to the second terminal of the fifth transistor Q5.

For example, the compensation voltage outputted by the compensation voltage acquisition circuit 30 can be written into the second terminal of the first capacitor C1 through the fifth transistor Q5 in turn-on state, and due to the bootstrap effect of the capacitor, the compensation voltage $V_1$ can be written into the first terminal of the first capacitor C1 (that is, the voltage of the first terminal of the first capacitor C1 after compensating is $V_{Data}$+V1) as an increment.

For example, how the compensation control circuit 5 writes the compensation voltage $V_1$ into the first terminal of the first capacitor C1 as the increment will be detailedly described below. For example, because the first terminal of the first capacitor C1 is in a floating state during the compensation light-emitting phase B, charges stored in the first capacitor C1 cannot be changed abruptly, that is, the charges stored in the first capacitor C1 remains unchanged; correspondingly, according to the principle of charge conservation of the capacitor, the voltage difference between two terminals of the first capacitor C1 also remains unchanged; because the voltage of the second terminal of the first capacitor C1 is increased from 0 V to $V_1$, the voltage of the first terminal of the first capacitor C1 can be increased from $V_{Data}$ to $V_{Data}+V_1$, so that the compensation control circuit 5 can write the compensation voltage $V_1$ into the first terminal of the first capacitor C1 (that is, the control terminal of the second transistor Q2) as an increment.

For example, because the pixel circuit 100 provided by the present embodiment can acquire the photosensitive voltage corresponding to the luminance of the light emitting element 1 based on the luminance of the light emitting element 1, and provide the photosensitive voltage to the control terminal of the second transistor Q2 as an increment, therefore, the conducting degree of the second transistor Q2 can be controlled and adjusted, the value of the driving current provided by the driving circuit 2 to the light emitting element 1 can be adjusted (for example, the light emitting luminance of the light emitting element 1 can be adjusted to the target luminance).

For example, the pixel circuit 100 provided by the present embodiment can obtain the compensation voltage and provide the obtained compensation voltage to the driving circuit 2 during the compensation light-emitting phase B. For another example, in a case that the third transistor Q3 is also in turn-on state during the charging phase A, the compensation voltage can be obtained and provided to the driving circuit 2 in the charging phase A.

For example, the compensation frequency to the luminance of the light emitting element 1 of the pixel circuit 100 provided by the present embodiment can be set according to specific application requirements, no specific limitation will be given to the embodiment of the present disclosure. For example, the pixel circuit 100 provided by the present embodiment can compensate the luminance of the light emitting element 1 in real time during the compensation light emitting phase of each driving period (or display period); for another example, the pixel circuit 100 provided by the present embodiment can also compensate the luminance of the light emitting element 1 once for the compensation light emitting phase of each driving period; for yet another example, the pixel circuit 100 provided by the present embodiment can also compensate the luminance of the light emitting element 1 once for every predetermined driving period (such as, 20 driving periods).

For example, the pixel circuit 100 provided by the present embodiment achieves the luminance compensation function.

It is to be noted that, transistors in the first embodiment and other embodiments of the present disclosure can be thin film transistors (such as, polysilicon thin film transistors, amorphous silicon thin film transistors, oxide thin film transistors or organic thin film transistors) or field effect transistors or other switch elements with same characteristics. A source electrode and a drain electrode of a transistor used herein can be symmetrical in structures, and therefore the source electrode and the drain electrode of the transistor in the embodiments of the present disclosure can be indistinguishable in physical structures. In the embodiments of the present disclosure, in order to distinguish terminals of the transistor, except for a gate electrode of the transistor taken as a control terminal, one of the two electrodes is directly described as a first terminal, and the other of the two electrodes is described as a second terminal. Therefore, the first terminal and the second terminal of all of or part of the transistors in the embodiments of the present disclosure are interchangeable as needed. For example, the first terminal of the transistor in the embodiments of the present disclosure can be the source electrode, the second terminal can be the drain electrode; alternatively, the first terminal of the transistor can be the drain electrode, and the second terminal can be the source electrode.

Third Embodiment

The present embodiment provides a driving method of a pixel circuit, the driving method of the pixel circuit can be applied to any one of the pixel circuits provided by the embodiments of the present disclosure. For example, the driving method of the pixel circuit can comprise the following steps:

Step S100: driving a light emitting element to emit light;

Step S200: obtaining a compensation voltage based on luminance of the light emitting element, in which the compensation voltage is provided to a driving circuit.

For example, a method of driving the light emitting element to emit light can be referred to the embodiments of the pixel circuit, and no further descriptions will be given herein.

For example, in the step S200, obtaining of the compensation voltage based on the luminance of the light emitting element can comprise the following steps:

Step S210: detecting the luminance of the light emitting element to obtain a photosensitive signal corresponding to the luminance of the light emitting element;

Step S220: comparing the photosensitive signal with a reference signal to obtain the compensation voltage.

For example, in the step S210, the photosensitive signal corresponding to the luminance of the light emitting element obtained during detecting the luminance of the light emitting element can be $V_0$. For example, in the step S220, the compensation voltage $V_1$obtained by comparing the photosensitive signal $V_0$with the reference signal $V_{Ref}$ is $V_1=r(V_{Ref}-V_0)$, in which r is the compensation coefficient. For example, methods of detecting the luminance of the light emitting element and obtaining the compensation voltage $V_1$ can be referred to the embodiments of the pixel circuit, and no further descriptions will be given herein.

For example, according to actual requirements, the driving method of the pixel circuit further comprise: controlling whether to provide an electrical signal outputted by the driving circuit to the light emitting element or not. For example, a specific method of controlling whether to provide the electrical signal outputted by the driving circuit to the light emitting element or not can be referred to the embodiment of the pixel circuit, and no further descriptions will be given herein.

For example, according to actual requirements, the driving method of the pixel circuit further comprise: providing the compensation voltage to the driving circuit. For example, specific methods of providing the compensation voltage to the driving circuit can be referred to the embodiments of the pixel circuit, and no further descriptions will be given herein.

For example, because the driving method of the pixel circuit provided by the present disclosure can obtain the compensation voltage corresponding to the luminance of the light emitting element based on luminance of the light emitting element, and can provide the photosensitive voltage to the driving circuit, for example, as an increment, the value of the driving current provided by the driving circuit to the light emitting element can be adjusted, so that the luminance of the light emitting element can be adjusted (for example, the luminance of the light emitting element can be adjusted in real time).

Fourth Embodiment

The present embodiment provides a display panel, and the display panel can comprise any one of the pixel circuits provided by the embodiments of the present disclosure. The present embodiment further provides a display device, and the display device can comprise any one of the pixel circuits provided by the embodiments of the present disclosure or any one of the display panels provided by the embodiments of the present disclosure. For example, the display device can beany products or components having a display function, such as an electronic paper, an OLED panel, a mobile phone, a tablet computer, a television, a monitor, a notebook computer, a digital photo frame, or a navigator.

It is to be noted that, other indispensable components (such as, a control device, an image data encoding/decoding device, a row scan driver, a column scan driver, a clock circuit and the like), which should be included as an understanding of those skilled in the art, of the display panel and the display device are not further described here and shall not be constructed as the limitation of the embodiments of the present disclosure.

An embodiment of the present disclosure provides a pixel circuit and a driving method thereof, a display panel and display device, so as to implement a luminance compensation function.

Obviously, various changes, modifications and combinations can be made by those skilled in the art to the present disclosure, without departing from the spirits and the scope of the present disclosure. Therefore, so far as these changes, modifications and combinations fall within the scope of the claims of the present disclosure and their equivalent technology, the present disclosure intends to cover such changes, modifications and combinations.

What are described above is related to the exemplary embodiments of the present disclosure only and not limitative to the scope of the disclosure; and the scopes of the disclosure are defined by the accompanying claims.

The application claims priority to the Chinese patent application No. 201611227008.7, filed Dec. 27, 2016, the entire disclosure of which is incorporated herein by reference as part of the present application.

What is claimed is:

1. A pixel circuit, comprising:

a light emitting element;

a driving circuit, configured to drive the light emitting element to emit light;

a luminance detection circuit, configured to detect luminance of the light emitting element and obtain a photosensitive voltage corresponding to the luminance of the light emitting element according to the luminance of the light emitting element;

a voltage comparison circuit, configured to compare the photosensitive voltage with a reference voltage to obtain a compensation voltage, wherein the reference voltage is a photosensitive voltage obtained by the luminance detection circuit in a case that the luminance of the light emitting element is target luminance;

a compensation control circuit, configured to provide the compensation voltage to the driving circuit; and the luminance detection circuit comprises a photosensitive element and a resistor coupled to the photosensitive element in parallel, a first terminal of the photosensitive element is coupled to an input terminal of the voltage comparison circuit, and a second terminal of the photosensitive element is grounded.

2. The pixel circuit according to claim 1, wherein the driving circuit is electrically coupled with a first power supply terminal, the compensation control circuit and the light emitting element;

the compensation control circuit is electrically coupled with an output terminal of the voltage comparison circuit;

the luminance detection circuit is electrically coupled with an input terminal of the voltage comparison circuit; and a second terminal of the light emitting element is electrically coupled with a second power supply terminal.

3. The pixel circuit according to claim 2, further comprising a light emitting control circuit, wherein the light emitting control circuit is configured to control whether to drive the light emitting element to emit light or not.

4. The pixel circuit according to claim 3, wherein the driving circuit comprises a first transistor, a second transistor and a first capacitor;

a control terminal of the first transistor is coupled to a scan line, a first terminal of the first transistor is coupled to a signal line, and a second terminal of the first transistor is coupled to a control terminal of the second transistor and a first terminal of the first capacitor;

a first terminal of the second transistor is coupled to the first power supply terminal, and a second terminal of the second transistor is coupled to the light emitting element or the light emitting control circuit; and a second terminal of the first capacitor is coupled to the compensation control circuit.

5. The pixel circuit according to claim 4, wherein the light emitting control circuit comprises a third transistor, a control terminal of the third transistor is coupled to a light emitting control line, a first terminal of the third transistor is coupled to the second terminal of the second transistor, and a second terminal of the third transistor is coupled to a first terminal of the light emitting element.

6. The pixel circuit according to claim 4, wherein the compensation control circuit comprises a fourth transistor and a fifth transistor;

a control terminal of the fourth transistor is coupled to the scan line, a second terminal of the fourth transistor is coupled to the second terminal of the first capacitor and a first terminal of the fifth transistor, and a first terminal of the fourth transistor is grounded; and a control terminal of the fifth transistor is coupled to a compensation control line, a second terminal of the fifth transistor is coupled to the voltage comparison circuit, and the first terminal of the fifth transistor is coupled to the second terminal of the first capacitor.

7. A display panel, comprising the pixel circuit according to any one of claim 1.

8. A display device, comprising the pixel circuit according to any one of claim 1.

9. A driving method of a pixel circuit, comprising:

driving, by a driving circuit of the pixel circuit, a light emitting element to emit light;

detecting, by a luminance detection circuit of the pixel circuit, luminance of the light emitting element, and obtaining, by the luminance detection circuit, a photosensitive voltage corresponding to the luminance of the light emitting element according to the luminance of the light emitting element;

comparing, by a voltage comparison circuit of the pixel circuit, the photosensitive voltage with a reference voltage to obtain a compensation voltage, wherein the reference voltage is a photosensitive voltage obtained in a case that the luminance of the light emitting element is target luminance; and providing, by a compensation control circuit of the pixel circuit, the compensation voltage to the driving circuit, wherein the luminance detection circuit comprises a photosensitive element and a resistor coupled to the photosensitive element in parallel, a first terminal of the photosensitive element is coupled to an input terminal of the voltage comparison circuit, and a second terminal of the photosensitive element is grounded.

10. The driving method of the pixel circuit according to claim 9, wherein a value of the photosensitive voltage corresponding to the luminance of the light emitting element is $V_0$, a value of the reference voltage is $V_{ref}$, a value of the compensation voltage provided to the driving circuit is $V_1$, $V_1=r\ (V_{Ref}-V_0)$, wherein r is a compensation coefficient.

11. A pixel circuit, comprising:

a light emitting element;

a driving circuit, configured to drive the light emitting element to emit light; and a compensation voltage acquisition circuit, configured to obtain a compensation voltage based on luminance of the light emitting element, wherein the compensation voltage is provided to the driving circuit, wherein the compensation voltage acquisition circuit comprises a luminance detection circuit configured to detect the luminance of the light emitting element to obtain a photosensitive signal corresponding to the luminance of the light emitting element, and a signal comparison circuit, configured to compare the photosensitive signal with a reference signal to obtain the compensation voltage;

the luminance detection circuit comprises a photosensitive element and a first resistor coupled to the photosensitive element in parallel;

the photosensitive element is configured to convert light incident onto the photosensitive element into a photosensitive current signal, the first resistor is configured to convert the photosensitive current signal into a photosensitive voltage signal;

the signal comparison circuit comprises a first input terminal, a second input terminal and a signal output terminal, the first input terminal is configured to receive a reference voltage signal, the second input terminal is coupled to a first terminal of the photosensitive element, so as to receive the photosensitive voltage signal, and the signal output terminal is configured to output the compensation voltage obtained based on the reference voltage signal and the photosensitive voltage signal; and a second terminal of the photosensitive element is grounded.

12. The pixel circuit according to claim 11, further comprising a compensation control circuit, wherein the compensation control circuit is configured to provide the compensation voltage to the driving circuit.

13. The pixel circuit according to claim 12, further comprising a light emitting control circuit, wherein the light emitting control circuit is configured to control whether to drive the light emitting element to emit light or not.

14. The pixel circuit according to claim 13, wherein the driving circuit comprises:

a driving element, configured to be capable of driving the light emitting element to emit light;

a light emitting selection circuit, configured to be capable of writing a basic data signal into a control terminal of the driving element; and a first capacitor, configured to be capable of keeping the basic data signal at the control terminal of the driving element.

15. The pixel circuit according to claim 14, wherein the driving circuit further comprises a first node;

the light emitting selection circuit comprises a first transistor, a first terminal of the first transistor is configured to be electrically coupled to a signal line, a second terminal of the first transistor is configured to be electrically coupled to the first node;

the driving element comprises a second transistor, a first terminal of the second transistor is configured to be electrically coupled to a first power supply terminal, and a second terminal of the second transistor is configured to be electrically coupled to the light emitting element or the light emitting control circuit; and a first terminal of the first capacitor is configured to be electrically coupled to the first node, and a second terminal of the first capacitor is configured to be electrically coupled to the compensation control circuit.

16. The pixel circuit according to claim 11, wherein the compensation control circuit comprises:

an initial voltage providing circuit, configured to provide an initial voltage to the driving circuit; and a compensation voltage providing circuit, configured to provide the compensation voltage to the driving circuit.

17. The pixel circuit according to claim 16, wherein the pixel circuit further comprises a second node, wherein a second terminal of the first capacitor is configured to be electrically coupled to the second node;

the initial voltage providing circuit comprises a fourth transistor, a first terminal of the fourth transistor is electrically coupled to a third power supply terminal, and a second terminal of the fourth transistor is electrically coupled to the second node;

the compensation voltage providing circuit comprises a fifth transistor, a first terminal of the fifth transistor is electrically coupled to the second node, and a second terminal of the fifth transistor is electrically coupled to the output terminal of the signal comparison circuit.

* * * * *